US007280784B2

(12) United States Patent
Manabe

(10) Patent No.: US 7,280,784 B2
(45) Date of Patent: Oct. 9, 2007

(54) IMAGE FORMING APPARATUS WITH CONVEYANCE GUIDE MEMBER

(75) Inventor: Kenichi Manabe, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 151 days.

(21) Appl. No.: 11/203,119

(22) Filed: Aug. 15, 2005

(65) Prior Publication Data

US 2006/0051130 A1 Mar. 9, 2006

(30) Foreign Application Priority Data

Sep. 6, 2004 (JP) ..... 2004-258028

(51) Int. Cl.
*G03G 15/00* (2006.01)
*G03G 21/00* (2006.01)

(52) U.S. Cl. ..... 399/119; 399/113; 399/316

(58) Field of Classification Search ..... 399/119, 399/113, 111, 110, 316
See application file for complete search history.

(56) References Cited

U.S. PATENT DOCUMENTS 5,144,383 A * 9/1992 Murano et al. ..... 399/316
5,276,489 A * 1/1994 Kikuchi et al. ..... 399/316
5,406,355 A * 4/1995 Komuro et al. ..... 399/111
5,436,698 A * 7/1995 Ohtaka ..... 399/113
5,752,134 A * 5/1998 Hazama et al. ..... 399/113
7,113,734 B2 * 9/2006 Deguchi et al. ..... 399/316
2001/0033760 A1 * 10/2001 Sawanaka et al. ..... 399/316

FOREIGN PATENT DOCUMENTS

JP 63-304272 A * 12/1988
JP 04-329575 A * 11/1992
JP 05-080598 A * 4/1993
JP 2002-255401 9/2002

* cited by examiner

*Primary Examiner*—Sophia S. Chen
(74) *Attorney, Agent, or Firm*—Fitzpatrick, Cella, Harper & Scinto

(57) ABSTRACT

There are provided an image bearing member on which an electrostatic image is formed, a development unit that is detachably attachable relative to a main body of the apparatus and that develops the electrostatic image formed on the image bearing member, using developer, a positioning unit that positions the development unit relative to the image bearing member, a transfer unit that transfers a developer image formed on the image bearing member onto a recording medium at a transfer position, and a conveyance guide member that guides the recording medium which is being conveyed toward the transfer position. The conveyance guide member is made of material which is greater in rigidity than a frame member of the development unit, and is disposed on the frame member of the development unit.

4 Claims, 7 Drawing Sheets

(a)

(b)

IMAGE FORMING APPARATUS WITH CONVEYANCE GUIDE MEMBER

CROSS REFERENCE TO RELATED APPLICATION

This application claims the benefit of priority from the prior Japanese Patent Application No. 2004-258028 filed on Sep. 6, 2004, the entire contents of which are incorporated by reference herein.

BACKGROUND OF THE INVENTION

1. Field of the Invention

The present invention relates to an image forming apparatus such as a copying machine and a laser beam printer and the like, and more particularly relates to an image forming apparatus which is capable of conveying a recording medium to an image transfer unit with favorable accuracy.

2. Related Background Art

Conventionally, an electrophotographic type image forming apparatus such as a copying machine and a laser beam printer and the like forms a toner image on a photosensitive member drum and then allows a transfer unit to transfer the formed toner image onto a recording medium which is being conveyed to the transfer unit.

Such a conventional image forming apparatus has a guide member extending up to the vicinity of the photosensitive member drum, for reliably guiding the recording medium to a transfer portion at which the toner image is transferred, as shown in Japanese Patent Application Laid-Open (JP-A) No. 2002-255401.

FIGS. 6 and 7 are diagrams explaining a construction of a guide according to JP-A No. 2002-255401. As shown in FIGS. 6 and 7, a latent image is formed on a photosensitive member drum 501, and then the formed latent image is subjected to toner development by a development unit 502. Then, the toner image is transferred onto a recording medium which is being conveyed to a transfer unit 504, which constitutes a nip portion (transfer nip portion) in association with a transfer roller 503, to thereby record the image by applying a transfer bias to the transfer roller 503.

Moreover, between a conveyance roller pair 505 for conveying the recording medium, and the transfer unit 504, an upper transfer guide 506 and a lower transfer guide 507 are disposed to reliably convey the recording medium to be conveyed, to the transfer unit 504.

The transfer unit 504, the upper transfer guide 506, and the lower transfer guide 507 are mounted to a conveyance frame 508. This conveyance frame 508 is pivotably supported on a front side plate and a rear side plate (both not shown) with a supporting point as a center, and then the development unit 502 is slidable in the directions of an arrow m (left and right directions) in FIG. 6.

FIG. 6 shows a state in which the transfer roller 503 abuts on the photosensitive member drum 501, and FIG. 7 shows a state in which the conveyance frame 508 is pivoted downward to retract the transfer roller 503 from the photosensitive member drum 501, and the development unit 502 is slid to a retracted position.

The upper transfer guide 506 and the lower transfer guide 507 are arranged at locations such that their tip portions stand very close to the photosensitive member drum 501 with a gap of about 1 to 3 mm in order to reliably guide the recording medium to the transfer nip portion. Particularly, the upper transfer guide 506 is disposed at a location which is closest to the photosensitive member drum 501, which enables a positional relationship between the photosensitive member drum 501 and the upper transfer guide 506 to be ensured with a high degree of accuracy.

[Patent Document] Japanese patent publication No. 2002-255401A

According to the prior art, the development unit 502 is slidable in the left and right directions in FIG. 6, as described above, and the upper transfer guide 506 which is disposed in the vicinity of the development sleeve 502*a* in the development unit 502 is fixed to the conveyance unit 508; therefore, many components should be interposed between the development sleeve 502*a* and the upper transfer guide 506, which requires the upper transfer guide 506 to be arranged away from the development sleeve 502*a* by a distance which is set by taking the variation of the component dimensional accuracy into consideration.

However, making a gap between the upper transfer guide 506 and the photosensitive member drum 501 wider disables the recording medium to be smoothly guided to the transfer nip portion, thereby enabling the recording medium to be conveyed to the photosensitive member drum 501 with a touch of abutment, which causes the shock resulting from the recording medium abutting on the photosensitive member drum 501 to influence the image. Furthermore, making the gap excessively wider may result in defective conveyance.

On the contrary, when misalignment between the upper transfer guide 506 and the photosensitive member drum 501 causes a tip portion of the upper transfer guide 506 to get too close to the photosensitive member drum 501, the toner adhered to a surface of the photosensitive member drum 501 immediately before the transfer is readily adhered to the tip portion of the upper transfer guide 506, thereby causing the adhered toner to be adhered to the recording medium, which may deteriorate the quality of image.

Therefore, it has not been easy to mount the upper transfer guide 506 on to the photosensitive member drum 501 or the development sleeve 502*a* with favorable accuracy, taking the variation of the component dimensional accuracy into consideration.

SUMMARY OF THE INVENTION

It is, therefore, an object of the present invention to provide an image forming apparatus which is capable of readily improving the guide member positional accuracy relative to a transfer position.

In order to attain the above-mentioned object, an image forming apparatus comprises an image bearing member on which an electrostatic image is formed, a development unit that develops the electrostatic image formed on the image bearing member, using developer, and the development unit is detachably attachable to a main body of the image forming apparatus, a positioning unit that positions the development unit relative to the image bearing member, a transfer unit that transfers a developer image formed on the image bearing member onto a recording medium at a transfer position, and a conveyance guide member that guides the recording medium which is being conveyed toward the transfer position, wherein the conveyance guide member is made of a material which is greater in rigidity than a frame member of the development unit, and is disposed on the frame member of the development unit.

DESCRIPTION OF THE PREFERRED EMBODIMENT

An image forming apparatus according to an embodiment of the present invention will now be described herein below with reference to FIGS. 1 to 5.

<General Arrangement of Image Forming Apparatus>

Figure 5:
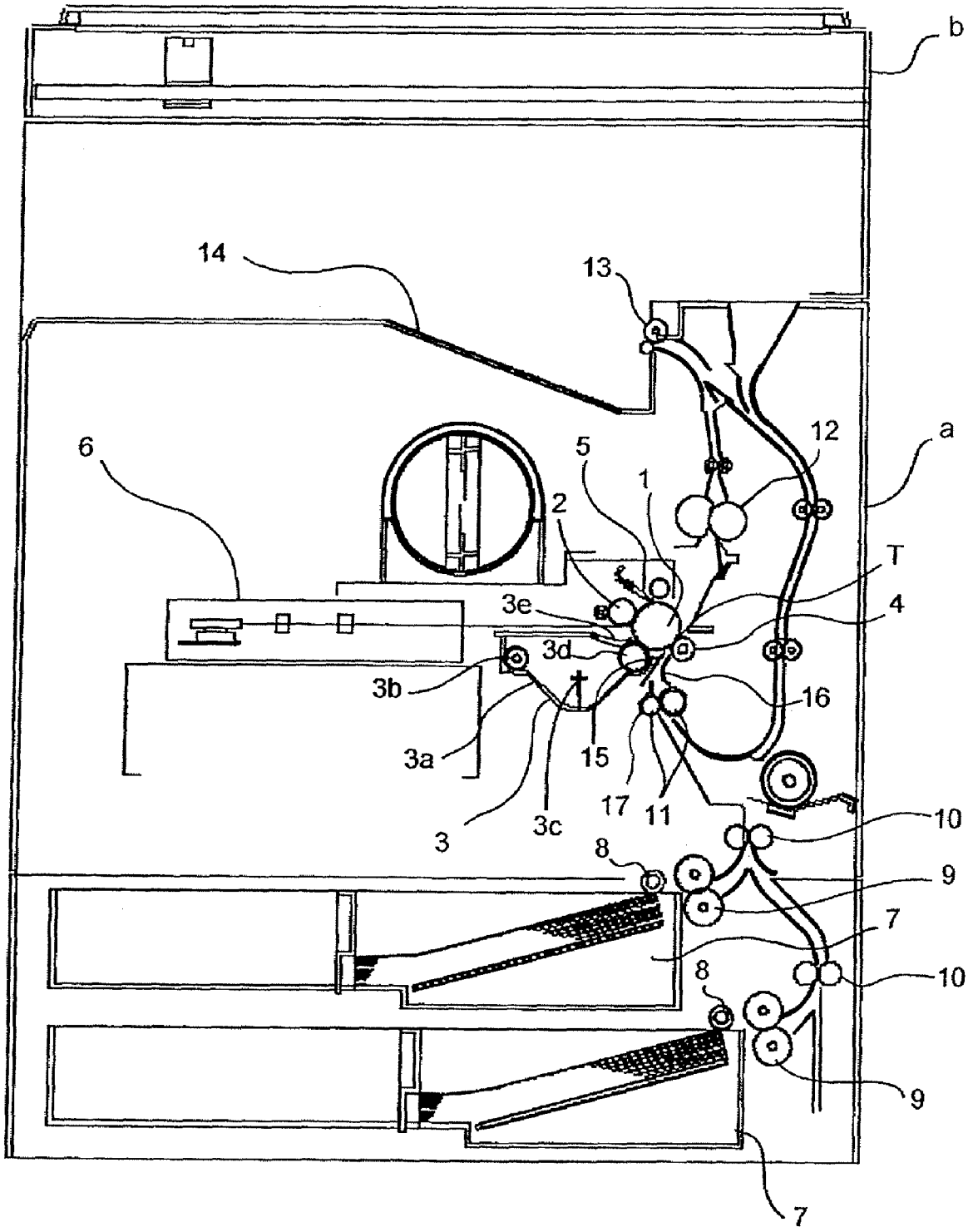
FIG. 5 is a sectional view of an image forming apparatus according to the embodiment of the present invention.
Figure 6:
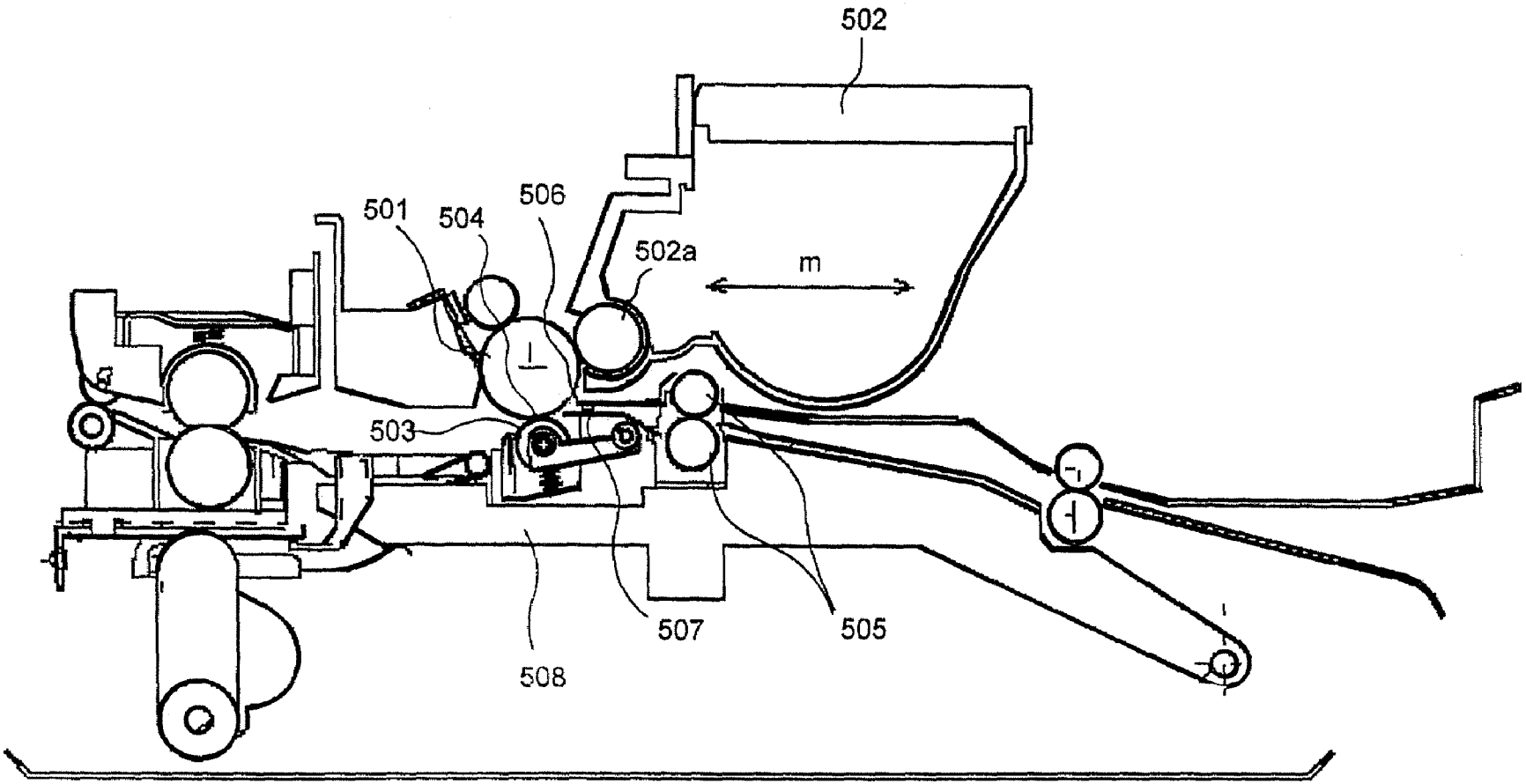
FIG.6 PRIOR ART
FIG. 6 is a view which explains a construction of a conventional transfer unit.
Figure 7:
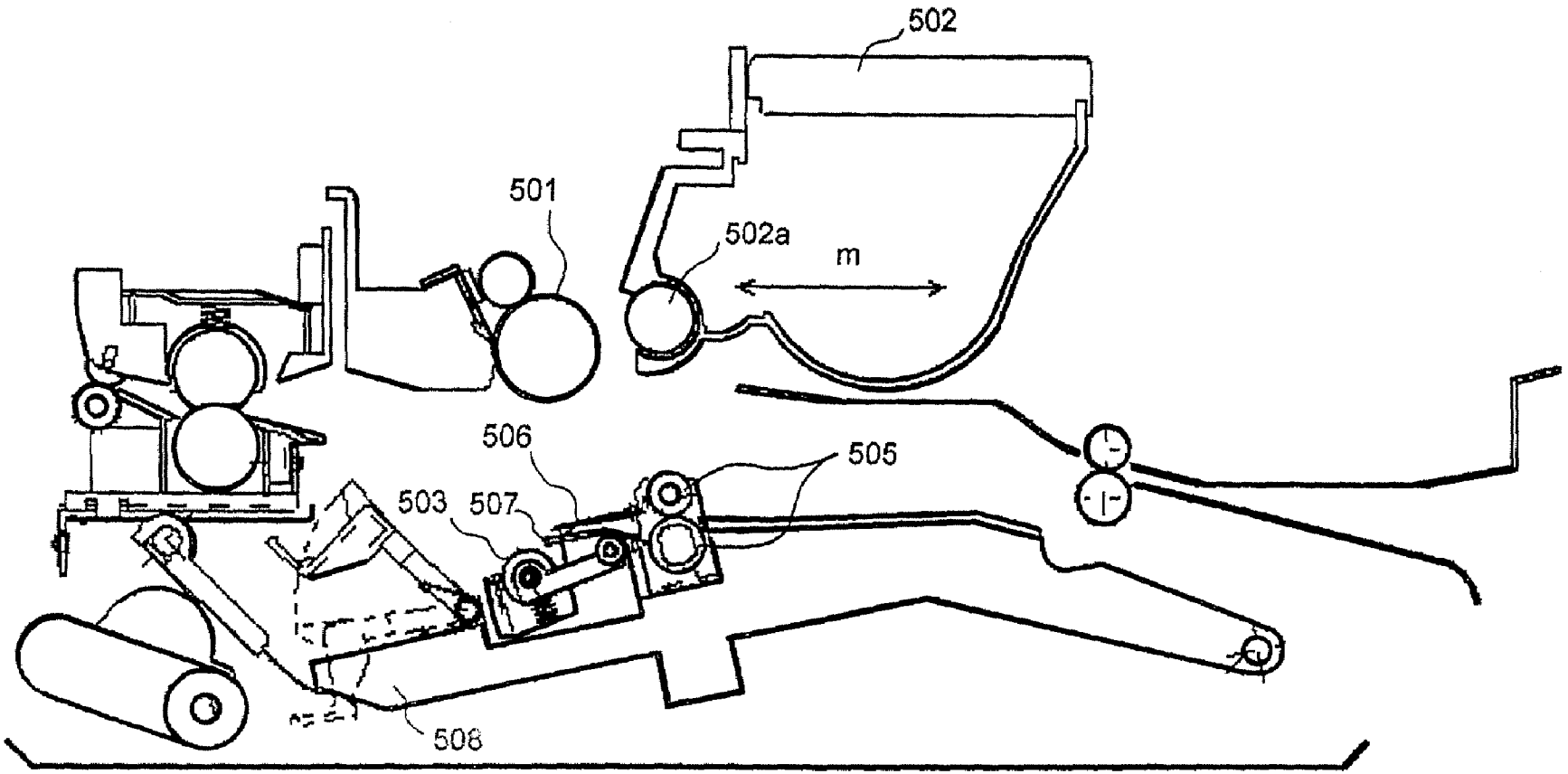
FIG.7 PRIOR ART
FIG. 7 is a view which explains a construction of a conventional transfer unit.

Referring first to FIG. 5, there is illustrated a general arrangement of an image forming apparatus according to an embodiment of the present invention. Moreover, FIG. 5 is a view that schematically explains the whole image forming apparatus.

The image forming apparatus according to the present embodiment comprises an electrophotographic type copying machine, in which an image reading unit b is disposed at an upper portion of an image forming unit a. The image forming unit a has a photosensitive member drum 1 as an image bearing member rotatably disposed therein, and further has, around the photosensitive member drum 1, a charger roller 2 for charging the photosensitive member drum 1 in a uniform manner, a development unit 3 as a development unit for toner-developing an electrostatic latent image, a transfer roller 4 for applying a bias to transferring the toner image formed on the photosensitive member drum 1 onto a recording medium being conveyed, and a cleaning unit 5 for removing the toner remaining on the photosensitive member drum 1 after the toner image has been transferred.

On this occasion, the development unit 3 is composed such that toner contained in a development container 3*a* is conveyed in the front and back directions by a screw 3*b* and an agitating paddle 3*c* to thereby be supplied to the photosensitive member drum 1 with an amount of the toner restricted by a development blade 3*e*.

In the event of the image formation, a laser scanner 6 scans a surface of the photosensitive member drum 1, which is uniformly charged, using a laser light corresponding to image information to thereby form a latent image on the surface of the photosensitive member drum 1, and then the development unit 3 toner-develops the latent image to thereby form a toner image on the photosensitive member drum 1.

A feeding unit, which is constructed by a feeding roller 8, separating roller pair 9, conveyance roller pair 10, and registration roller pair 11 and the like, feeds recording media one by one as such in synchronization with the formation of the toner image, from a cassette 7 set in a lower portion of a main body of the apparatus.

Then, the toner image on the photosensitive member drum 1 is transferred onto the recording medium at a transfer unit which is a nip portion (transfer nip potion T) between the photosensitive member drum 1 and the transfer roller 4. This recording medium is conveyed to a fixing unit 12 where the toner image is fixed, and then discharged to a discharge unit 14 at an upper portion of the apparatus through discharge roller pair 13.

Moreover, between the registration roller pair 11 and the transfer nip portion T are disposed an upper transfer guide member 15, a lower transfer guide member 16 and an after-registration guide 17, which are for guiding a sheet being conveyed, to the transfer nip portion T.

<Construction of Positioning Development Unit and Photosensitive Member Drum>

Next, there will be described hereinbelow a construction of positioning the development unit 3 and the photosensitive member drum 1. Together with the charger roller 2 and the cleaning unit 5, the photosensitive member drum 1 is housed in a drum cartridge 23 which is installed to the main body of the image forming apparatus. Moreover, the development unit 3 is constructed as a development cartridge and is detachably attachable to the main body of the image forming apparatus. Then, there is provided a development-positioning unit that positions members of the development unit including the development sleeve 3*d* and the like relative to the photosensitive member drum when attaching the development cartridge.

Figure 1:
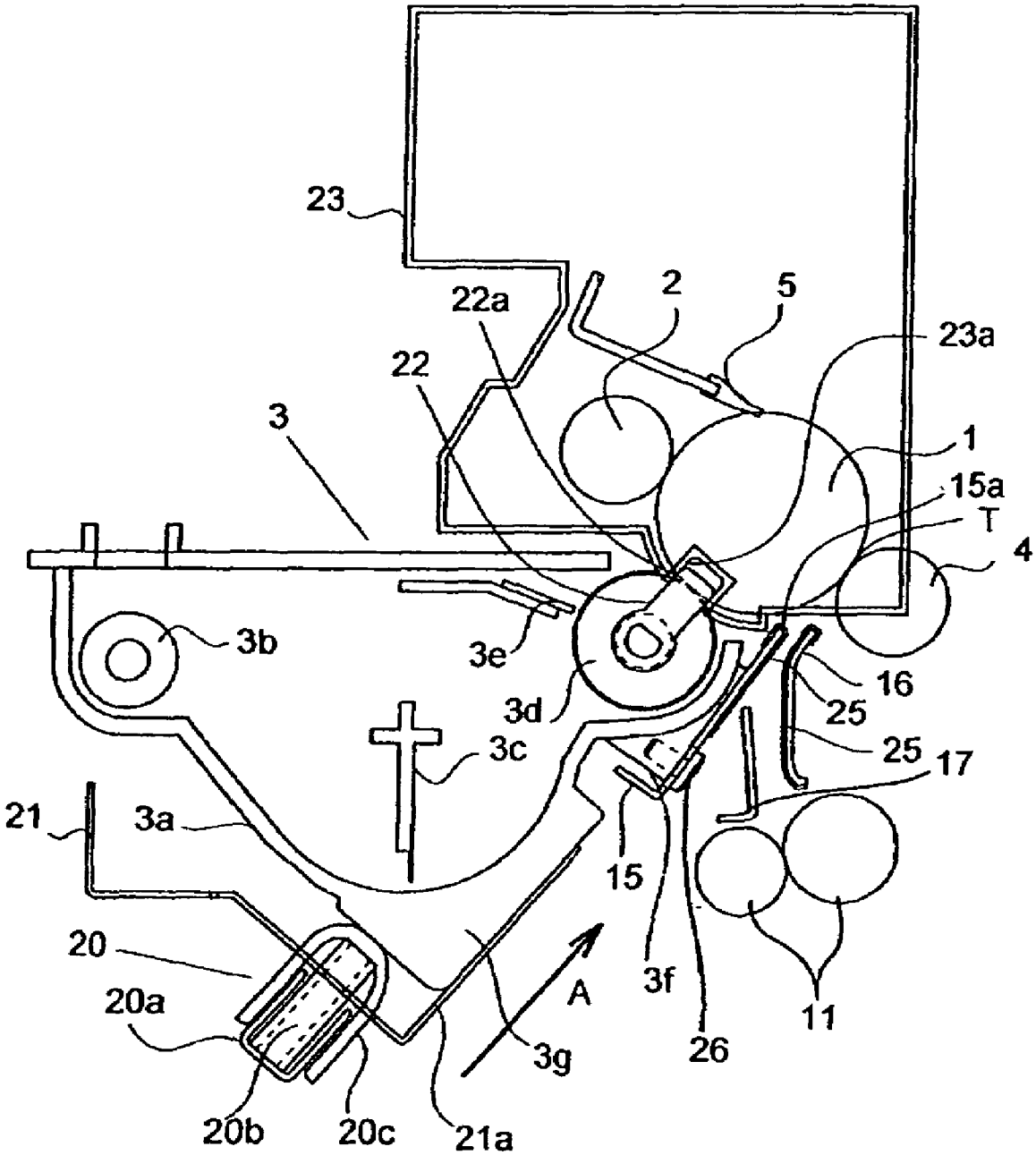
FIG. 1 is a view which explains in detail an image transfer unit according to an embodiment of the present invention.

As shown in FIG. 1, in the development unit 3, the abutting surface portion 3*g* integral with the development container 3*a* abuts on an inclined surface 21*a* of a development stay 21 fixed to the main body of the apparatus, and the abutting surface portion 3*g* is biased by a pressing unit (a pressing shaft 20*a*, a pressing spring 20*b*, and a pressing cam 20*c*); therefore, the development unit 3 attached to the main body of the apparatus is pressed in the direction of an arrow A along the inclined surface 21*a*.

Figure 2:
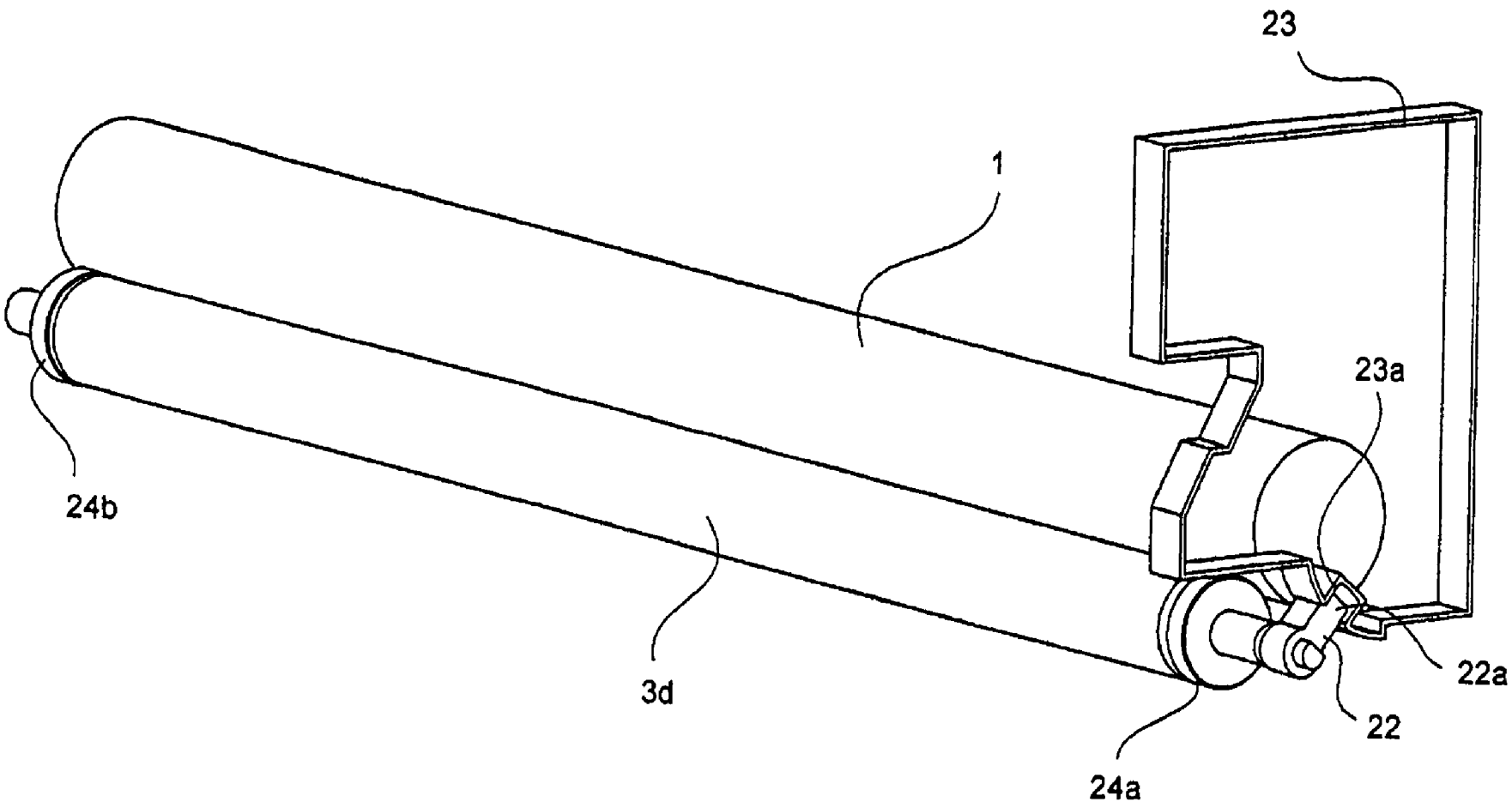
FIG. 2 is a view which explains a development sleeve-positioning construction according to the embodiment of the present invention.

Further, as shown in FIGS. 1 and 2, bearing units for supporting longitudinal direction-wise both ends of the development sleeve 3*d* are provided with positioning members 22, respectively. When the development unit 3 is installed to the main body of the apparatus, a tip portion 22*a* of the positioning member 22 is fitted into a positioning groove 23*a* as a positioning unit formed on the drum cartridge 23, which is a holding frame member of an image bearing member.

Moreover, as shown in FIG. 2, abutment members 24*a*, 24*b* are rotatably attached to the longitudinal direction-wise both ends of the development sleeve 3*d*. Each of these abutment members 24*a*, 24*b* has an outer diameter which is about 0.4 to 0.5 mm greater than that of the development sleeve 3*d*. Accordingly, the abutment members 24*a*, 24*b* abutting against both end portions (non-image region) of the photosensitive member drum 1 ensure a minute gap of about 0.2 to 0.3 mm between the photosensitive member drum 1 and the development sleeve 3*d* with a high degree of accuracy.

The development unit 3 is thus pressed in the direction of the arrow A by the pressing unit 20, and then the development sleeve 3*d* and the development unit 3 are positioned relative to the photosensitive member drum 1 with a high degree of accuracy by the positioning member 22, the positioning groove 23*a*, and the abutment members 24*a*, 24*b*.

As described above, by a simple construction of fitting the positioning member 22 into the positioning groove 23*a* and then causing the abutment members 24*a*, 24*b* to abut against the photosensitive member drum 1, the development sleeve 3*d* is positioned relative to the photosensitive member drum 1.

<Construction of Conveyance Guide Member>

Next, in the guide members for guiding the recording medium to the transfer unit, the upper transfer guide member 15 as a conveyance guide member, an end of which is closest to the photosensitive member drum 1, will be described with regard to its construction hereinbelow.

The upper transfer guide member 15 is, as shown in FIG. 1, disposed in the vicinity of the transfer unit in which many components are disposed in a narrow space. Accordingly, the upper transfer guide member 15 is required to be made as thin as possible in thickness, and to be constructed by a member having such rigidity as to guide the recording medium being conveyed. In this embodiment, the frame body of the development unit 3 including the development container 3*a* is constructed by a mold-formed article made of a resin, whereas the upper transfer guide member 15 is constructed by a metal plate member which is greater in rigidity than the frame body, in which the rigidity depends on the Young's modulus of a material constituting the frame body and the guide members. In a case where a material constituting the frame body of the development unit is a synthetic resin of PPE (polyphenylene ether resin) and PS (polystyrene resin), the Young's modulus is 9 $KN/mm^2$, whereas in a case where the guide members are made of, for example, SUS, the Young's modulus is 190 $KN/mm^2$.

Thus constructing the upper transfer guide member 15 by a material which is greater in rigidity than the frame body of the development unit enables the thickness of the upper transfer guide member 15 to be made thinner than the frame body of the development unit, which enables the upper transfer guide member 15 to be disposed in a narrow space.

In the embodiment, the upper transfer guide member 15 is made of a conductive metal member, and can be applied with a bias. Therefore, when conveying the recording medium, applying a bias which is identical in polarity with the toner prevents the toner on the surface of the photosensitive member drum to be fixed to the upper transfer guide member 15, which enables the tip portion 15*a* of the upper transfer guide member 15 to be arranged close to the surface of the photosensitive member drum.

The upper transfer guide member 15 is covered by an insulation sheet 25 at its recording medium contacting side surface, which prevents the transfer bias from leaking from the recording medium to the upper transfer guide member 15 to thereby deteriorate the quality of image. Moreover, in this embodiment, the lower transfer guide member 16 is covered by an insulation sheet 25 at its recording medium contacting side surface.

The upper transfer guide member 15 is fixed to a guide mounting portion 3*f*, which is integral with the development container 3*a*, by means of fixing threads 26. To this end, the upper transfer guide member 15 is mounted to the development unit 3 having a development sleeve 3*d*, the positioning member 22 for positioning the development sleeve 3*d* to the drum cartridge, and the abutment members 24*a*, 24*b* for holding a gap between the development sleeve 3*d* and the photosensitive member drum 1 with a high degree of accuracy and the like, which enables the upper transfer guide member 15 to be mounted to the photosensitive member drum 1 easily and with a high degree of accuracy, irrespective of the variation of the component dimensional accuracy.

Figure 3:
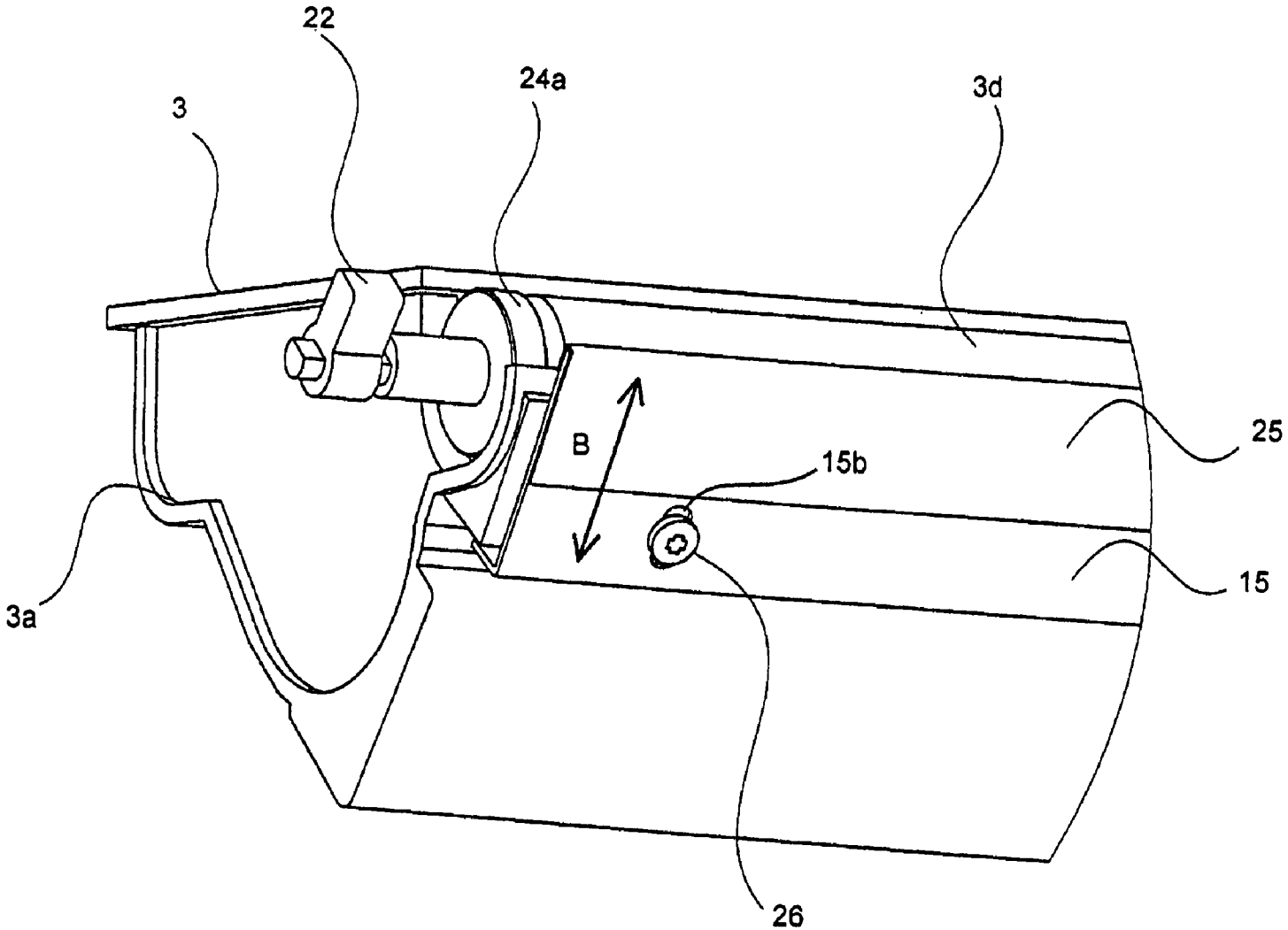
FIG. 3 is a view which explains the manner of mounting an upper transfer guide according to the embodiment of the present invention.
Figure 4:
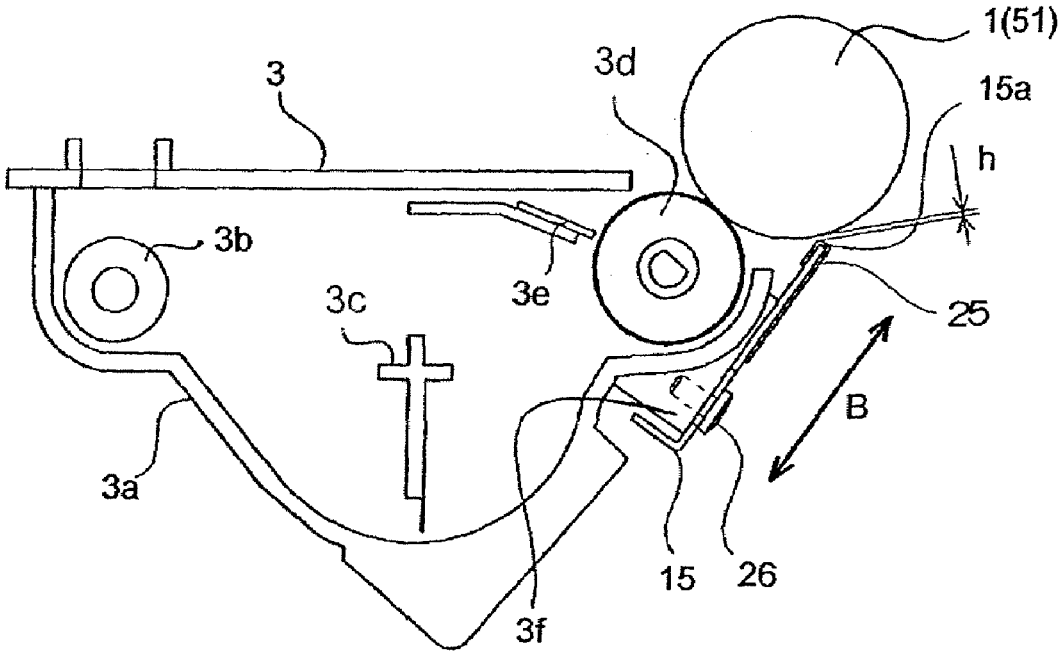
FIGS. 4(*a*) and (*b*) are views which explain an upper transfer guide member-mounting position according to the embodiment of the present invention.
Figure 4:
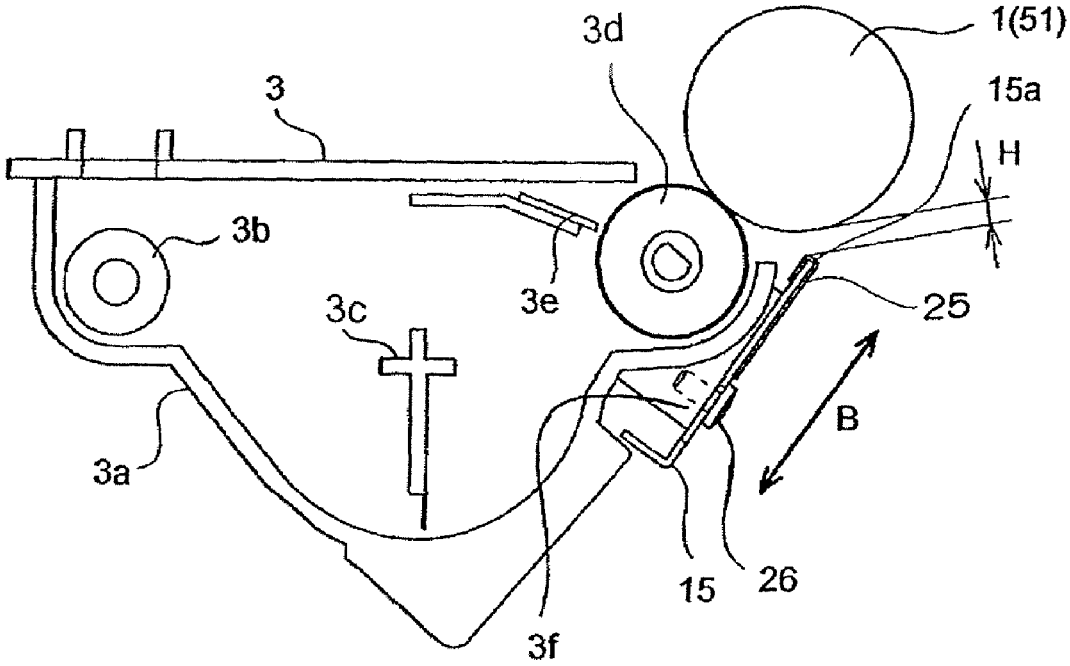

Besides, as shown in FIG. 3, a threaded hole 15*b* disposed on the upper transfer guide member 15 for threadedly mounting the upper transfer guide member 15 is formed as an elongate hole in the conveyance direction of the recording medium. To this end, when mounting the upper transfer guide member 15 on to the guide mounting portion 3*f*, sliding the upper transfer guide member 15 in the direction of an arrow B within a range of the elongate hole enables a gap h between the tip portion 15*a* of the upper transfer guide member 15 and the photosensitive member drum 1 to narrow as shown in FIG. 4A, or enables a gap H between the tip portion 15*a* of the upper transfer guide member 15 and the photosensitive member drum 1 to widen as shown in FIG. 4B, with possible adjustment.

Therefore, the upper transfer drum member 15 can be installed, with the development unit 3 abutting against a dummy drum 51 which is identical in diameter with the photosensitive member drum 1 and with a gap between the upper transfer guide member 15 and the dummy drum 51 adjusted, thereby causing the gap to be formed with a high degree of accuracy.

This prevents a positional relationship between the upper transfer guide member 15 and the photosensitive member drum 1 from being misaligned.

Further, fixing the upper transfer guide member 15 to the development container 3*a* eliminates the special need for the member for mounting the upper transfer guide member 15, thereby reducing the number of components between the development sleeve 3*d* and the upper transfer guide member 15. Then, disposition within the same unit suppresses the variation between the components as much as possible, which eliminates the need for spaced-apart disposition taking the variation into consideration. This leads to a small-footprint between the upper transfer guide member 15 and the development sleeve 3*d* or the photosensitive member drum 1.

Moreover, in the above-mentioned embodiment, the upper transfer guide member 15 is made of a conductive metal to thereby increase its rigidity; however, the upper transfer guide member 15 need not be limited to a metal material if it can be constructed by a thin plate-like member having such rigidity as not to be subjected to deflection and the like.

Further, in the above-mentioned embodiment, the upper transfer guide member 15 is made of a conductive metal, receives a bias which is identical in polarity with the toner, and is covered by the insulation sheet 25 at its recording medium contacting side surface. However, in the image forming apparatus which is capable of conveying a recording medium without problems, even if a gap between the tip portion 15*a* of the upper transfer guide member 15 and the photosensitive member drum 1 is wide to a certain degree, the upper transfer guide member 15 is difficult to be subjected to adhesion of the toner. This eliminates the need for applying the bias which is identical in polarity with the toner to the upper transfer guide member 15, and then the upper transfer guide member 15 may be made of an insulating material.

What is claimed is:

1. An image forming apparatus comprising:

an image bearing member on which an electrostatic image is formed;

a development unit that develops the electrostatic image formed on the image bearing member with using developer, and the development unit is detachably attachable to a main body of the image forming apparatus;

a positioning unit that positions the development unit relative to the image bearing member;

a transfer unit that transfers a developer image formed on the image bearing member on to a recording medium at a transfer position; and a conveyance guide member that guides the recording medium which is being conveyed toward the transfer position, wherein the conveyance guide member is made of a material which is greater in rigidity than a frame member of the development unit, and is disposed on the frame member of the development unit.

2. An image forming apparatus according to claim 1, wherein the conveyance guide member is made of a metal.

3. An image forming apparatus according to claim 2, wherein the metal is conductive.

4. An image forming apparatus according to claim 1, wherein the conveyance guide member is provided slidably in a recording medium-moving direction relative to the frame member of the development unit.

* * * * *